US010449117B2

(12) United States Patent
Sarkar

(10) Patent No.: US 10,449,117 B2
(45) Date of Patent: Oct. 22, 2019

(54) STOPPER FOR MEDICAMENT CONTAINERS

(71) Applicant: Q HOLDING COMPANY, Twinsburg, OH (US)

(72) Inventor: Amalendu Sarkar, Charlotte, NC (US)

(73) Assignee: Q HOLDING COMPANY, Twinsburg, OH (US)

( * ) Notice: Subject to any disclaimer, the term of this patent is extended or adjusted under 35 U.S.C. 154(b) by 298 days.

(21) Appl. No.: 15/512,807

(22) PCT Filed: Sep. 22, 2015

(86) PCT No.: PCT/US2015/051358
§ 371 (c)(1),
(2) Date: Mar. 20, 2017

(87) PCT Pub. No.: WO2016/048964
PCT Pub. Date: Mar. 31, 2016

(65) Prior Publication Data

US 2017/0281466 A1 Oct. 5, 2017

Related U.S. Application Data

(60) Provisional application No. 62/054,746, filed on Sep. 24, 2014.

(51) Int. Cl.
*A61J 1/14* (2006.01)
*B65D 51/00* (2006.01)

(52) U.S. Cl.
CPC ..... *A61J 1/1406* (2013.01); *B65D 51/002* (2013.01)

(58) Field of Classification Search
CPC .. A61J 1/1406; B65D 51/002; B65D 41/0414
See application file for complete search history.

(56) References Cited

U.S. PATENT DOCUMENTS

| | | | | |
|---|---|---|---|---|
| 3,780,935 | A * | 12/1973 | Lukacs | G01N 33/491 210/789 |
| 4,066,183 | A | 1/1978 | Armstrong | |
| 4,152,269 | A | 5/1979 | Babson | |
| 6,375,022 | B1 | 4/2002 | Zurcher et al. | |
| 2008/0311321 | A1 | 12/2008 | Sparholt et al. | |
| 2010/0206836 | A1 | 8/2010 | Koshidaka et al. | |
| 2013/0245592 | A1 | 9/2013 | Glaser et al. | |
| 2014/0042163 | A1* | 2/2014 | Waeben | A61J 1/1412 220/254.1 |

FOREIGN PATENT DOCUMENTS

WO WO-2010108450 A1 9/2010

OTHER PUBLICATIONS

Vacutainer, Wikipedia, https://web.archive.org/web/20120304220510/https://en.wikipedia.org/wiki/Vacutainer, accessed Mar. 8, 2019, captured Mar. 4, 2012 (Year: 2012).*

International Search Report and Written Opinion of International Application No. PCT/US2015/051358, dated Dec. 14, 2015, 9 pages.

* cited by examiner

*Primary Examiner* — Ariana Zimbouski
(74) *Attorney, Agent, or Firm* — Moyles IP, LLC

(57) ABSTRACT

A stopper is generally provided in which a hollow shell includes at least one outer layer and an inner layer positioned within the outer layer. The outer layer is formed from a substantially solid polymer while the inner layer is formed from a cold-flowable polymer. The cold-flowable polymer is deformable when an object is inserted therein and is scalable when the object is removed.

20 Claims, 3 Drawing Sheets

STOPPER FOR MEDICAMENT CONTAINERS

CROSS-REFERENCE TO RELATED APPLICATIONS

This application claims priority to PCT Application No. PCT/US15/51358 filed Sep. 22, 2015, which claims the benefit of U.S. Provisional Patent Application No. 62/054,746 filed Sep. 24, 2014, which is incorporated herein by reference in its entirety.

FIELD

A stopper for medicament containers is generally described. In particular, the stopper described herein provides for sealing of a medicament container, such that the medicament container provides multiple doses and is reusable after a needle is inserted therein.

BACKGROUND

A stopper and/or septum is often employed when closing opened portions of containers used to retain chemicals or medical liquids, such as those used in drug delivery applications. As used herein, the terms stopper and septum are used interchangeably. A stopper is usually designed to meet various quality requirements such as closing properties, gas barrier properties, chemical resistance, needling resistance, low reactivity and the like. Typically, to meet these quality requirements, a conventional stopper is made of a rubber having high elastic deformation, such as polyisoprene elastomer. Other types of rubbers used include synthetic rubbers such as butylene rubber and isoprene rubber, thermoplastic styrene elastomers such as SEBS, thermoplastic elastomers mainly comprising polyisobutylene and polybutadiene, and the like.

Such rubber stoppers facilitate entry of a hollow needle, for instance, a syringe, hypodermic needle, or drug delivery needle, often used to pierce through the stopper from an upper surface to a lower surface thereof to withdraw/extract an amount of a chemical or medical liquid from the container. In order for the needle to efficiently extract the required amount of medicament, the stopper has to be designed in a manner to prevent coring or blockage of the inner pathway of the needle. In addition, when medical liquid is kept in the container, the rubber stopper should be properly sealed, chemically pure, and free from migratory plasticizers and other potential allergic ingredients in order to prevent infection or transmission of these impurities to, for example, a patient or another chemical or medical liquid.

While the containers housing the chemical or medical liquid are often sterilized prior to the introduction of chemicals or medical liquids, the stoppers used to close or contain them are not. When a conventional stopper is penetrated by a needle, the puncture provides a potential path for microorganisms, such as viruses and bacteria, and/or contaminants to enter the interior portion of the sterile container, and therefore the container is often regarded as compromised and needs to be discarded. While stoppers can be used for multiple punctures to assess their robustness, they are usually designed to serve as single dose/single use containers when used, for example, in a medical setting. Vaccine vials, for example, are often used only once after immunizing a patient; however, they may contain unused vaccine that can be used to help protect against diseases. Disposal of these containers, often leads to disposal of costly and limited quantities of medicament.

There remains a need for an improved container stopper that provides a hermetically sealed container when a needle is inserted into the container, liquid is withdrawn, and then the needle is withdrawn and also allows for a multi-dose reusable medicament container.

SUMMARY

It is an object to provide a stopper or septum for medicament containers that is self-sealing and/or capable of being resealed after it has been penetrated, e.g. by a needle. The stopper is made of a hollow shell forming at least one outer layer and an inner layer positioned within the outer layer. The outer layer is formed from a substantially solid polymer and the inner layer is formed from a cold-flowable polymer. The cold-flowable polymer is deformable when an object, such as a needle, is inserted therein thereby forming a gap or fractured path and is capable of reforming to its original shape and/or seal the fractured path when the object is removed. A medicament container is also provided, having a body portion and a sealable stopper as described herein.

BRIEF DESCRIPTION OF THE DRAWINGS

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

DETAILED DESCRIPTION

Reference will now be made in detail to various embodiments. Each example is provided by way of explanation, and is not meant as a limitation and does not constitute a definition of all possible embodiments.

As used herein with respect to the claimed stopper, the terms "sealing", "sealable", or "scaled" are used interchangeably and mean the ability of at least portions of the stopper that self-seal or reseal after an object, such as a needle, has been inserted, then removed from a medicament container, and more particularly, form the stopper. As used herein, the term "cold-flowable," or the like, refers to a property of a material, such as a polymer, wherein the material is under constant deformation mode under its own self-compressive load at a temperature of about 15° C. to about 30° C., In some embodiments, the material may be under a constant deformation mode under its own self-compression mode at a temperature of about 18° C. to about 30° C., or alternatively at a temperature of about 20° C. to about 25° C. As used herein, "container," may be a rigid container, such as a vial, or a flexible container, such as a bag. The stopper may be used in vials to cap an opening after filling the vial. For a flexible container, such as a bag, the stopper may be used at a port for removing material from or introducing material into the container. Such a port is standard on most intravenous (IV) bags.

Embodiments of the disclosure relate generally to a stopper for a container, and more particularly to a stopper for medicament containers. In an embodiment, the stopper is configured for use as a self-sealing and/or resealable stopper for use with medicament containers. The stopper includes a plurality of layers, having outer layers and an inner layer. The outer layers are formed from a substantially solid polymer and the inner layer is formed from a cold-flowable polymer. The cold-flowable polymer is deformable when an object, for example a needle, is inserted therein thereby forming a gap or fractured path, and is capable of reforming to its original shape and/or seal the fractured path when the object is removed. As such, the stopper is capable of being sealed after a first object is removed, and is capable of being sealed after subsequent uses. This enables the medicament container to be used more than once.

For purposes of illustrating features of the embodiments, a simple example will now be introduced and referenced throughout the disclosure. Those skilled in the art will recognize that this example is illustrative and not limiting, and is provided purely for explanatory purposes.

Figure 1:
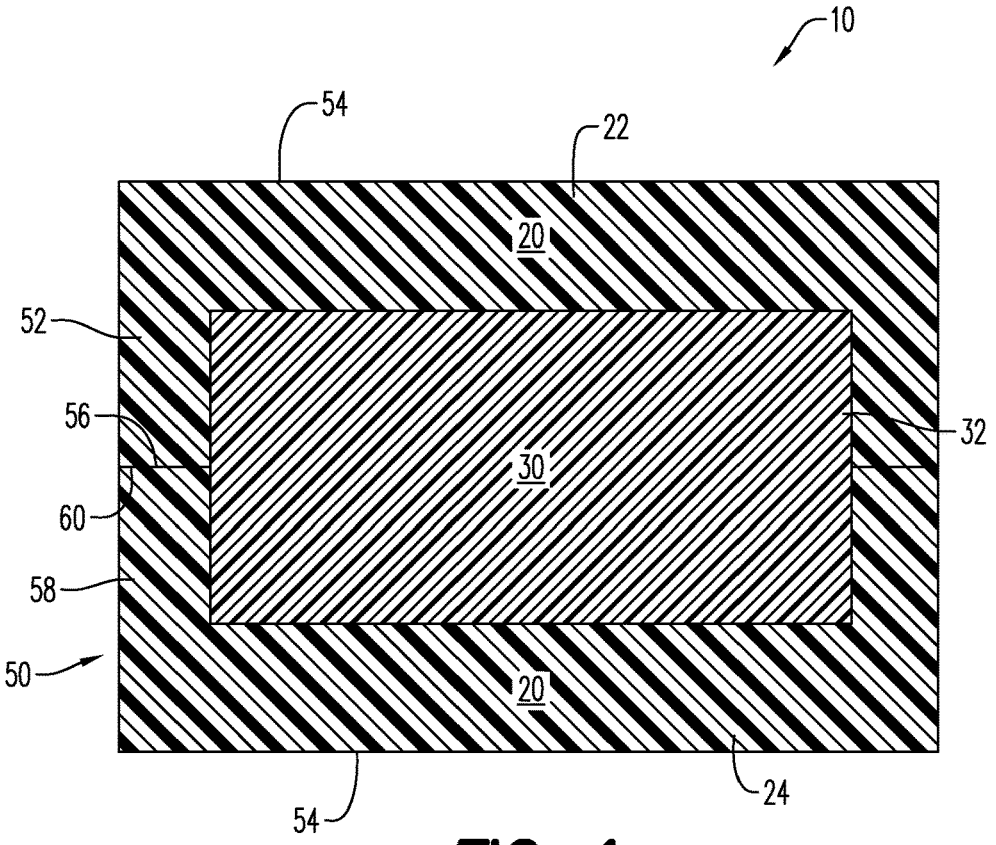
FIG. 1 is a stylized drawing showing a cross-section view of a stopper having an inner layer positioned within a hollow shell, according to an embodiment.
Figure 2:
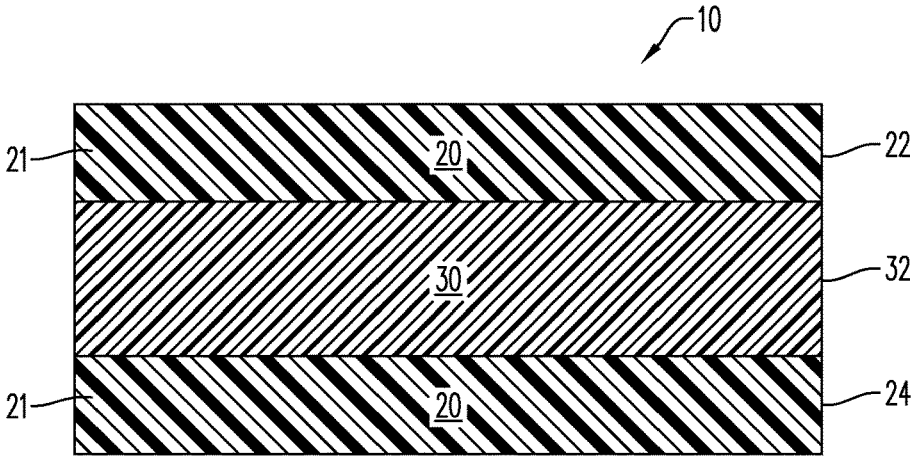
FIG. 2 is a drawing depicting a cross-section view of a stopper having a plurality of layers according to an embodiment.

In an embodiment and with particular reference to FIGS. 1 and 2, a stopper 10 is shown. In an embodiment and with particular reference to FIG. 1, a hollow shell 50 forms an outer layer or outer boundary (not shown in this Figure) of the stopper 10, and is typically formed of a substantially solid polymer 20. While the hollow shell 50 can be injection molded as a single component, it may also be formed of one or more components. According to an aspect, the hollow shell 50 includes an upper layer 22 and a lower layer 24. Walls 52, 58, respectively, extend from a needle penetrable surface 54 of each of the upper layer 22 and the lower layer 24 and surround an open end 56, 60, respectively. In an embodiment, the open end 56 of the upper layer 22 and the open end 60 of the lower layer 24 are positioned facing each other, and the walls 52 of the upper layer 22 are connected or otherwise joined to the walls 58 of the lower layer 24. An inner layer 32 may be encapsulated within or encased by the hollow shell 50—a function of the outer layer or boundary providing a structure capable of retaining, encasing and/or encapsulating the inner layer 32 therein. In an embodiment, the inner layer includes a cold flowable polymer 30. In an embodiment, (not shown) the cold-flowable polymer 30 may be encapsulated by one of the upper layer 22 or the lower layer 24, not both. In this embodiment, the upper layer 22 or the lower layer 24 may contain a void (not shown in the Figures) at its center. The void may be filled with the cold-flowable polymer 30. In an embodiment, the inner layer 32 is configured to accommodate any size gauge needle, such as 16 gauge, 18 gauge, and 21 gauge needles, without detriment to the performance of the cold-flowable polymer 30. Notably, the cold-flowable polymer 30 forming the inner layer 32 is housed within the hollow shell 50, thereby taking the shape of the hollow shell 50.

Now referring particularly to FIG. 2, in an embodiment the stopper 10 may include a plurality of layers, including outer layers 21 and inner layer 32 positioned between the outer layers 21. The outer layers 21 are formed from at least a substantially solid polymer 20, while the inner layer 32 is formed from a cold-flowable polymer 30. As shown in FIG. 2, in an embodiment, one outer layer 21 is configured as a first or upper layer 22 and the other outer layer 21 is configured as a second or lower layer 24. While FIGS. 1 and 2 depict the substantially solid polymer 30 as forming a single upper layer 22 and a single lower layer 24, it is to be understood that in some embodiments, the substantially solid polymer 30 may have more than a single upper layer 22 and single lower layer 24. In some embodiments, there are 2, 3, 4, 5, or any other number of the layers, the number selected based on the needs of the application.

In an embodiment, the cold-flowable polymer 30 may lack self-sustainability, ie, it may be unable to retain its own shape without external support. In an embodiment, the cold-flowable polymer is thixotropic, having a gel-like consistency with a cross-linked network of polymer chains. In an embodiment, the cold-flowable polymer 30 has a viscosity of about 10 cps to about 18,000 cps at a temperature that is at least one of about 15° C. to about 30° C., about 18° C. to about 30° C., and about 20° C. to about 25° C. In an embodiment the cold-flowable polymer 30 has a viscosity of about 100 cps to about 50,000 cps at a temperature that is at least one of about 15° C. to about 30° C., about 18° C. to about 30° C., and about 20° C. to about 25° C. In an embodiment, the cold-flowable polymer has a viscosity of about 1,000 cps to about 30,000 cps at a temperature that is at least one of about 15° C. to about 30° C., about 18° C. to about 30° C., and about 20° C. to about 25° C. In at least an embodiment, the aforementioned viscosities allow the cold-flowable polymer 30 to quickly reform its polymeric networks which has undergone either scission or displacement at or below room temperature through a stress relaxation effects and intermolecular/intramolecular diffusion phenomenon.

In at least an embodiment, the cold-flowable polymer 30 may be formed from a biologically inert material. In an embodiment, the cold-flowable polymer 30 is deformable when an object is inserted therein. When the object is subsequently removed, the cold-flowable polymer 30 provides sealing of the stopper. This behavior occurs based on at characteristic of the polymer selected. In at least an embodiment, the cold-flowable polymer includes silicone, polyisoprene, isobutylene rubbers, polyurethanes, thermoplastic elastomers, polymer gels or combinations thereof. Each of these polymers has a plurality of polymeric networks having long-chain molecules. These long-chain molecules form networks through a chemical cross-linkage process. Such cross-linkage may be obtained by a radiation method, such as x-ray or ultraviolet, or any other process sufficient to cross-link long-chain molecules. When the networks have been formed, each long chain molecule loses its ability to move as an individual molecule. Therefore, as discussed in greater detail hereinbelow with reference to FIGS. 4A and 4B, when an object 90, such as a needle, is used to penetrate or forcibly separate the molecules from each other, thereby forming a gap 91, upon removal of the object 90, the flow characteristics of the molecules fills the gap 91 in the cold-flowable polymer previously created by the removed object 90.

Figure 3:
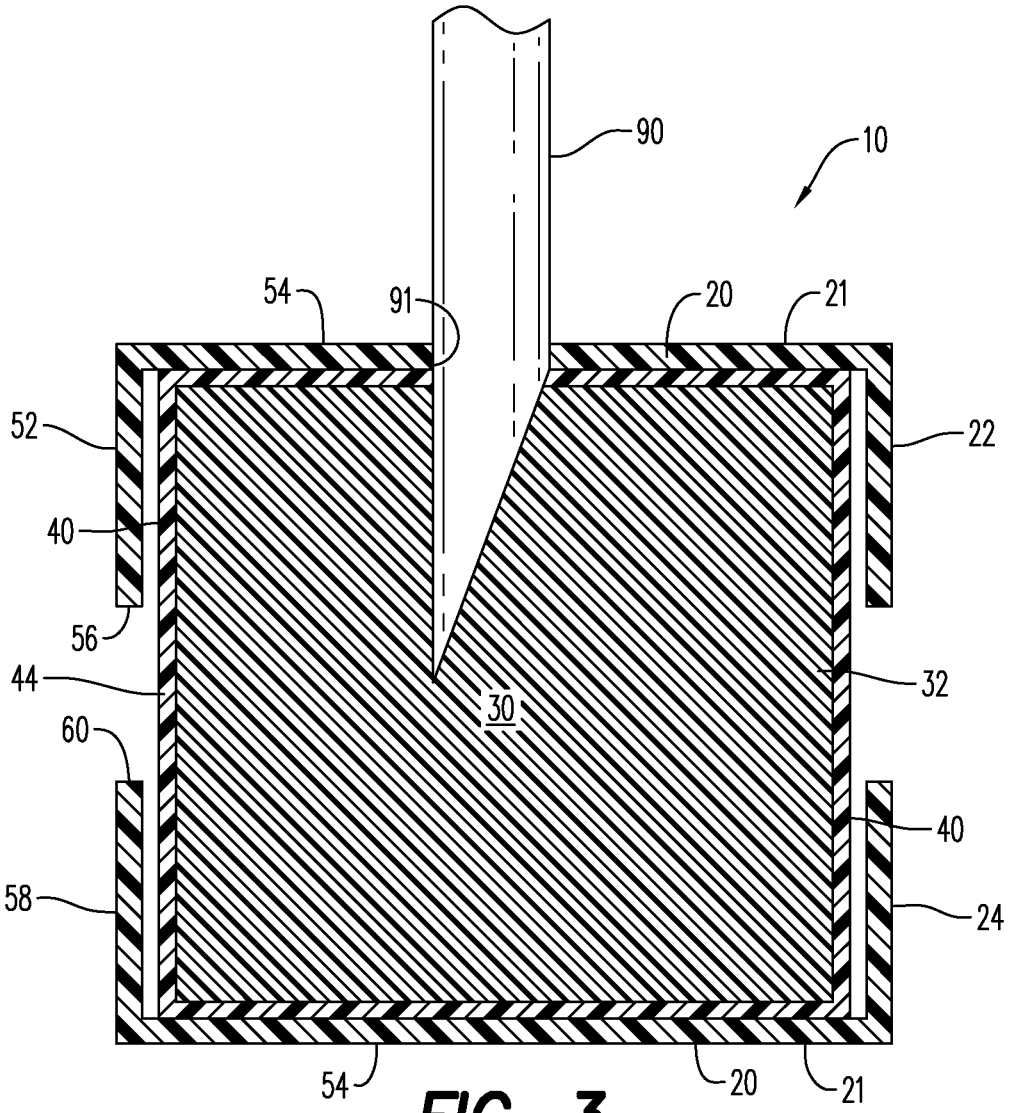
FIG. 3 is a stylized drawing showing a cross-section view of an embodiment with the inner layer housed within a casing.

In an embodiment and as depicted in FIG. 3, the stopper 10 includes a casing 40 to contain and/or encase the cold-flowable polymer 30. In this embodiment, the cold-flowable polymer 30 maintains the shape of the casing 40 within which it is encased. The casing 40 includes a hollow interior 42 surrounded by a perimeter wall 44. As depicted, in an embodiment, the perimeter wall 44 of the casing 40 at least partially encases the inner layer 32 and is positioned between the out layers 21, ie, the outer layers 21 at least partially surround the casing 40. In an embodiment, the outer layers 21 are positioned over at least an exterior surface of the casing 40 in a manner configured to retain the casing 40. The casing 40 is typically made of a plastic material, including polyvinyl chloride (PVC), polyethylene, polypropylene, polystyrene, polycarbonates, acrylonitrile butadiene styrene (ABS), polyurethanes, polyamides, thermoplastic elastomers, polyetheretherketone (PEEK) polysulfones, or combinations thereof.

Although FIGS. 1, 2, and 3 show a rectangular cross-section for the stopper 10, a person skilled in the art would understand the stopper 10 may have different cross-sectional shapes. For example, as depicted in U.S. Patent Application Publication No. 2010/0206836, the stopper may have a disc-like top portion and a cylindrical leg portion of smaller diameter. Those skilled in the art would recognize that stoppers of other shapes, sizes and configurations may be used in alternate embodiments.

In an embodiment, the substantially solid polymer 20 may be selected based on a polymer commonly used for closing containers, such as polymers used to make stoppers for use in medical applications. In an embodiment, the substantially solid polymer 20 is natural or synthetic rubbers, such as butylene rubber and isoprene rubber; thermoplastic styrene elastomers, such as styrene-ethylene/butylene-styrene (SEBS) and styrene-ethylene/propylene-styrene (SEPS); thermoplastic elastomers, such as polyisobutylene and polybutadiene; polydimethyl siloxanes (PDMS), such as polyvinyl siloxanes (PVS); phenyl-vinyl-methyl-silicone (PVMQ) and vinyl-methyl-silicone (VMQ); polyurethane; thermoplastic elastomers; ethylene propylene monomer (EPR); ethylenepropylenediene monomer (EPDM); thermoplastic urethanes; and combinations thereof. The substantially solid polymer 20 may be in its fully cured, partially cured, and/or uncured form.

Figure 4A:
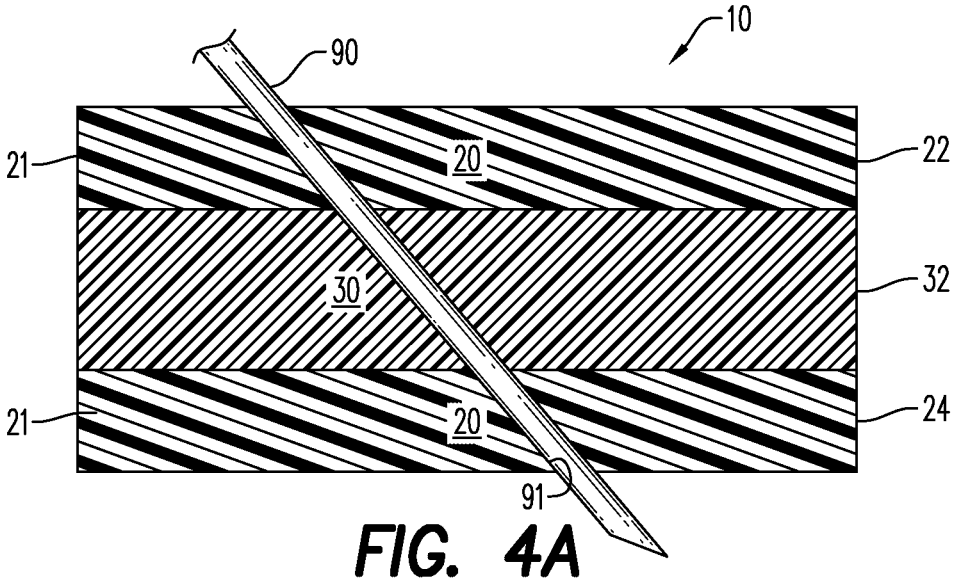
FIGS. 4A-4B are stylized drawings depicting the operation of the stopper upon insertion and withdrawal of an object, according to an embodiment; and Various features, aspects, and advantages of the embodiments will become more apparent from the following detailed description, along with the accompanying figures in which like numerals represent like components throughout the figures and text. The various described features are not necessarily drawn to scale, but are drawn to emphasize specific features relevant to some embodiments.
Figure 4B:
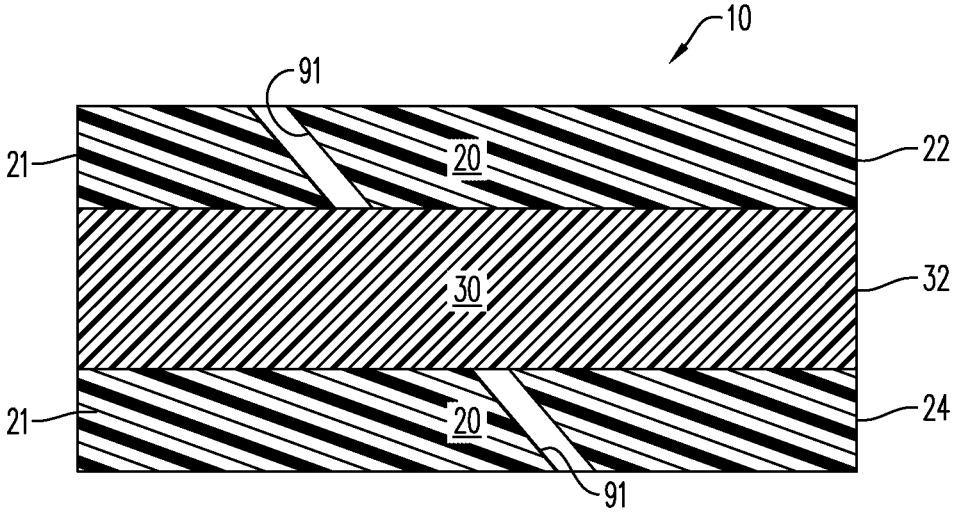

FIGS. 4A and 4B show the stopper 10 in operation, according to an embodiment. When the object 90, such as the needle, penetrates the stopper 10 (FIG. 4A), it creates a gap 91 through the upper layer 22, the inner layer 32, and the lower layer 24. The gap 91 created by the needle 90 spans all three layers 22, 32, and 24 of the stopper 10. When inserted into a container, such as a medicament container, the needle must span all three layers 22, 32, 24 to access the interior of the container to withdraw chemicals or medical fluid contained therein. When the needle is withdrawn from the stopper 10 (FIG. 4B), the gap 91 may remain formed in the layers formed from the substantially solid polymer 20, but the cold-flowable polymer 30 of the interior layer 32 flows into and fills the gap 91 created by the needle, thereby self-sealing and/or resealing the stopper 10.

In an embodiment (not shown), a medicament container includes a body portion and a stopper 10. The body portion is open at one end and configured to receive the stopper 10. The stopper 10 is sized to fit within the open end of the body portion by interference fit, for instance. The stopper 10 includes a plurality of layers, as described in various embodiments hereinabove, including at least outer layers 21 and an inner layer 32 positioned between the outer layers 21. The stopper 10 provides for a hermetically sealed medicament container. When a needle is inserted into the container to withdraw liquid, and the needle is subsequently withdrawn, the stopper 10 also allows for a multi-dose re-usable medicament container 100. In an embodiment, the body portion of the medicament container is made of a glass, a polymer, or combinations thereof.

In an embodiment, the stopper 10 is of any desired shaped. A molding process may be use to create the desired shape of the stopper 10. In an embodiment, the stopper 10 is made by at least one of casting, calendering, core extrusion, injection molding, compression molding, thermoforming, rotational molding, or any other such process that is capable of forming the desired shape of the stopper 10. In an embodiment, the process includes forming a molded hollow shell 50 or casing 40 using the substantially solid polymer 20, while maintaining a cavity or void located substantially central within the mold cavity, as would be understood by one of ordinary skill in the art. The process further includes injecting a cold-flowable polymer within the cavity.

The components and methods illustrated are not limited to the specific embodiments described herein, but rather, features illustrated or described as part of one embodiment can be used on or in conjunction with other embodiments to yield yet a further embodiment. Such modifications and variations are intended to be included. Further, steps described in the method may be utilized independently and separately from other steps described herein.

While the apparatus and method have been described with reference to alternative embodiments, it will be understood by those skilled in the art that various changes may be made and equivalents may be substituted for elements thereof without departing from the scope. In addition, many modifications may be made to adapt a particular situation or material to the teachings without departing from the essential scope thereof. In the interest of brevity and clarity, and without the need to repeat all such features, it will be understood that any feature relating to one embodiment described herein in detail, may also be present in an alternative embodiment.

In this specification and the claims that follow, reference will be made to a number of terms that have the following meanings. The singular forms "a," "an" and "the" include plural referents unless the context clearly dictates otherwise. Furthermore, references to "one embodiment" are not intended to be interpreted as excluding the existence of additional embodiments that also incorporate the recited features. Terms such as "first," "second," "upper," "lower," etc. are used to identify one element from another, and unless otherwise specified are not meant to refer to a particular order or arrangement or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of."

Advances in science and technology may make equivalents and substitutions possible that are not now contemplated by reason of the imprecision of language; these variations should be covered by the appended claims. This written description uses examples, including the best mode, and also to enable any person of ordinary skill in the art to practice, including making and using any devices or systems and performing any incorporated methods. The patentable scope is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A stopper for a container, comprising:

a hollow shell forming an outer layer of the stopper and comprising a solid polymer;

an inner layer disposed within the hollow shell, wherein the inner layer is formed from a cold-flowable polymer, the cold-flowable polymer being deformable when an object is inserted therein and sealable when the object is removed; and a casing having a peripheral wall and a hollow interior, wherein the peripheral wall at least partially encases the inner layer and the outer layer is positioned over at least an exterior surface of the casing.

2. The stopper of claim 1, wherein the hollow shell comprises an upper layer and a lower layer, each of the upper and lower layers having walls extending from a needle penetrable surface and forming an open end, the walls being attached at the open ends thereby forming the hollow shell within which the inner layer is retained.

3. The stopper of claim 1, wherein the cold-flowable polymer is made of at least one of silicone, polyisoprene, isobutylene based rubbers, polyurethanes, thermoplastic elastomers, and polymer gels.

4. The stopper of claim 1, wherein the cold-flowable polymer has a viscosity of about 10 cps to about 18,000 cps when tested at a temperature of about 15° C. to about 30° C.

5. The stopper of claim 1, wherein the solid polymer comprises at least one of natural rubber, a synthetic rubber, and a thermoplastic elastomer.

6. The stopper of claim 1, wherein the cold-flowable polymer is a biologically inert material.

7. A stopper for a container, comprising:

a casing having a peripheral wall and a hollow interior; and a plurality of layers including a plurality of outer layers and an inner layer positioned between the outer layers such that the peripheral wall at least partially encases the inner layer and the outer layers surround the peripheral wall, wherein the outer layers are formed from a solid polymer and the inner layer is formed from a cold-flowable polymer, the cold-flowable polymer being deformable when an object is inserted therein and sealable when the object is removed.

8. The stopper of claim 7, wherein the cold-flowable polymer is made of at least one of silicone, polyisoprene, isobutylene based rubbers, polyurethanes, thermoplastic elastomers, and polymer gels.

9. The stopper of claim 7, wherein the cold-flowable polymer has a viscosity of about 10 cps to about 18,000 cps when tested at a temperature of about 15° C. to about 30° C.

10. The stopper of claim 7, wherein the solid polymer comprises at least one of natural rubber, a synthetic rubber, and a thermoplastic elastomer.

11. The stopper of claim 7, wherein the stopper and the casing are cylindrical.

12. A medicament container comprising:

a body portion; and a stopper comprising a casing having a peripheral wall and a hollow interior, a plurality of layers including a plurality of outer layers and an inner layer positioned between the outer layers such that the peripheral wall at least partially encases the inner layer and the outer layers surround the peripheral wall, wherein the body portion is open at one end and configured to receive the stopper, and the outer layers are formed from a solid polymer and the inner layer is formed from a cold-flowable polymer, the cold-flowable polymer being deformable when an object is inserted therein and sealable when the object is removed.

13. The medicament container of claim 12, wherein the outer layers comprise an upper layer and a lower layer, each having walls extending from a needle penetrable surface and an open end.

14. The medicament container of claim 13, wherein the walls are attached at the open ends, forming a hollow shell within which the cold-flowable polymer is retained.

15. The medicament container of claim 12, wherein the body portion is made of at least one of a glass and a polymer.

16. The medicament container of claim 12, wherein the cold-flowable polymer is made of at least one of silicone, polyisoprene, isobutylene based rubber, polyurethane, thermoplastic elastomer, and polymer gel.

17. The medicament container of claim 12, wherein the solid polymer comprises at least one of a natural rubber, a synthetic rubber, and a thermoplastic elastomer.

18. The stopper of claim 1, wherein the casing comprises a plastic material.

19. The stopper of claim 7, wherein the casing comprises a plastic material.

20. The medicament container of claim 12, wherein the casing of the stopper comprises a plastic material.

* * * * *